United States Patent [19]

Andrew et al.

[11] 4,136,879

[45] Jan. 30, 1979

[54] INTERN BOARD GAME

[76] Inventors: Clifford G. Andrew; Louise B. Andrew, both of 555 Brook Rd., Towson, Md. 21204

[21] Appl. No.: 838,062

[22] Filed: Sep. 30, 1977

[51] Int. Cl.[2] ..... A63F 3/00

[52] U.S. Cl. ..... 273/243

[58] Field of Search ..... 273/243, 257, 256

[56] References Cited

U.S. PATENT DOCUMENTS

| | | | |
|---|---|---|---|
| 2,666,644 | 1/1954 | Strehlow et al. | 273/256 |
| 3,804,417 | 4/1974 | Dawson | 273/243 |
| 4,010,955 | 3/1977 | Nelson | 273/243 |

FOREIGN PATENT DOCUMENTS

| | | | |
|---|---|---|---|
| 2338061 | 8/1977 | France | 273/243 |

OTHER PUBLICATIONS

"Medigame;" Washington Evening Star; Feb. 12, 1969, p. D-1.

*Primary Examiner*—William H. Grieb
*Assistant Examiner*—Harry G. Strappello
*Attorney, Agent, or Firm*—Rose & Edell

[57] ABSTRACT

A board game portrays the trials, tribulations, and triumphs of an intern and is played on a board simulating a large teaching hospital. There are a plurality of major specialty departments and each player represents the intern from one department. At the start of the game each intern has plural patients in the Emergency Room awaiting admission to the specialty ward. The object of the game is for the intern to admit all of his patients by landing on appropriate patient spaces while traversing a path on the board and then diagnose and dispose of the patient by the use of diagnostic and treatment cards accumulated during the game. Disposition may involve treating the patient within the intern's own department, or transferring the patient to another intern's service where the illness could better be treated. While working towards these ends, the intern is obliged to answer all pages received, in the form of cards which are picked in response to landing on paging spaces, and to handle all complications as they arise. The game ends when any intern successfully discharges all the patients admitted or transferred to his service. The winner is that intern who through knowledge and efficiency has accumulated the most free time, in the form of scrip.

9 Claims, 12 Drawing Figures

INTERN BOARD GAME

BACKGROUND OF THE INVENTION

The present invention relates to board games and, more particularly to a board game related to the field of medicine.

There are numerous board games of the type wherein each player in turn moves his or her token along a prescribed path, as determined by a chance-determining element, and thereupon can enter into certain transactions determined by the nature of the game. For example, such games have dealt with real estate investment, the stock market, shopping, sporting events, etc. To our knowledge there has been only one such game which deals with medicine, namely; Medigame, a game in which each player experiences simulated health service transactions which relate in some way to Medicare. No board game of which we are aware deals with delivery of medical services from the point of view of a physician or, more specifically, of an intern.

Often in the past there have been some clever board games devised which deal with rather complex and technical subject matter. These games have not acheived wide public appeal because their highly technical nature made it difficult for the average person to fully understand the principles of the game. The fact that medicine is highly technical and therefore not well understood by lay people may be the reason for the lack of medically oriented board games.

It is an object of the present invention to provide a medically-oriented board game which deals with the complexities of medicine and yet is capable of being played by persons having virtually no knowledge of or experience in medicine.

It is another object of the present invention to provide a medical board game which is enjoyable to play and is also educational.

It is another object of the invention to provide a board game which simulates the life of an intern in a large teching hospital.

It is still another object of the present invention to provide a medical board game which can be played on one intellectual level wherein knowledge of medicine is important or at another intellectual level wherein no such knowledge is required but can be acquired during the course of play.

SUMMARY OF THE INVENTION

In accordance with the present invention a game board includes a continuous path divided primarily into patient spaces, diagnostic spaces, therapeutic spaces and paging spaces. In addition, there are plural specialty wards demarked on the board with subdivisions therein serving as beds. Each player is designated as an intern in a different specialty and moves his or her playing piece, in turn, a number of spaces determined by dice or other chance-determining apparatus. Each patient space is designated by an ailment related to one of the player's specialties. If a player lands on a patient space corresponding to that player's specialty, the patient may be admitted from the Emergency room to the corresponding specialty ward by placing that patient's card in a bed space. Upon landing on a diagnostic or therapeutic space the player is permitted to pick a diagnostic or therapeutic card which may or may not relate to his patients. The object of the game is for a player to: admit all of the patients relating to that player's specialty who are waiting in the emergency room by landing on each of these patient spaces; diagnosing the illness of each admitted patient by obtaining the appropriate diagnostic card; and disposing of the diagnosed patients by obtaining the appropriate therapeutic card; all while expending the minimum amount of time. Time is represented by scrip, each player starting with some and receiving more for each completion of the board path. An appropriate amount of time must be spent (i.e. scrip returned to the time bank) for each transaction such as admitting a patent, or picking a diagnostic or therapeutic card. In addition, upon landing on a paging space the player must randomly pack a paging card which determines, inter alia, how much additional time he must spend or receive.

Other subtleties in the play are described in greater detail below. When the first player has admitted and discharged all of his players, the game is over and the player having the most time remaining is the winner. Since each player must surrender time for all remaining unadmitted, undiagnosed and undischarged patients, the player who discharges all of his or her patients is normally the winner. Alternatively, and in a simpler form, time may be eliminated as the medium of exchange and the first player to admit and discharge all of his or her patients is the winner.

All of the patient spaces and diagnostic and therapeutic cards are color coded by specialty and include a brief one or two word name for the ailment, diagnosis and treatment, thereby permitting players having no knowledge of medicine to play and enjoy the game. The patient, diagnostic and therapeutic cards additionally include detailed medical descriptions of each ailment, diagnosis and treatment, so that additional enjoyment can be had by those with medical knowledge. A glossary of medical terms may be included to permit lay players to learn the medical details as they play.

While I have described and illustrated one specific embodiment of my invention, it will be clear that variations of the details of construction which are specifically illustrated and described may be resorted to without departing from the true spirit and scope of the invention as defined in the appended claims.

DESCRIPTION OF THE PREFERRED EMBODIMENT

Figure 1:
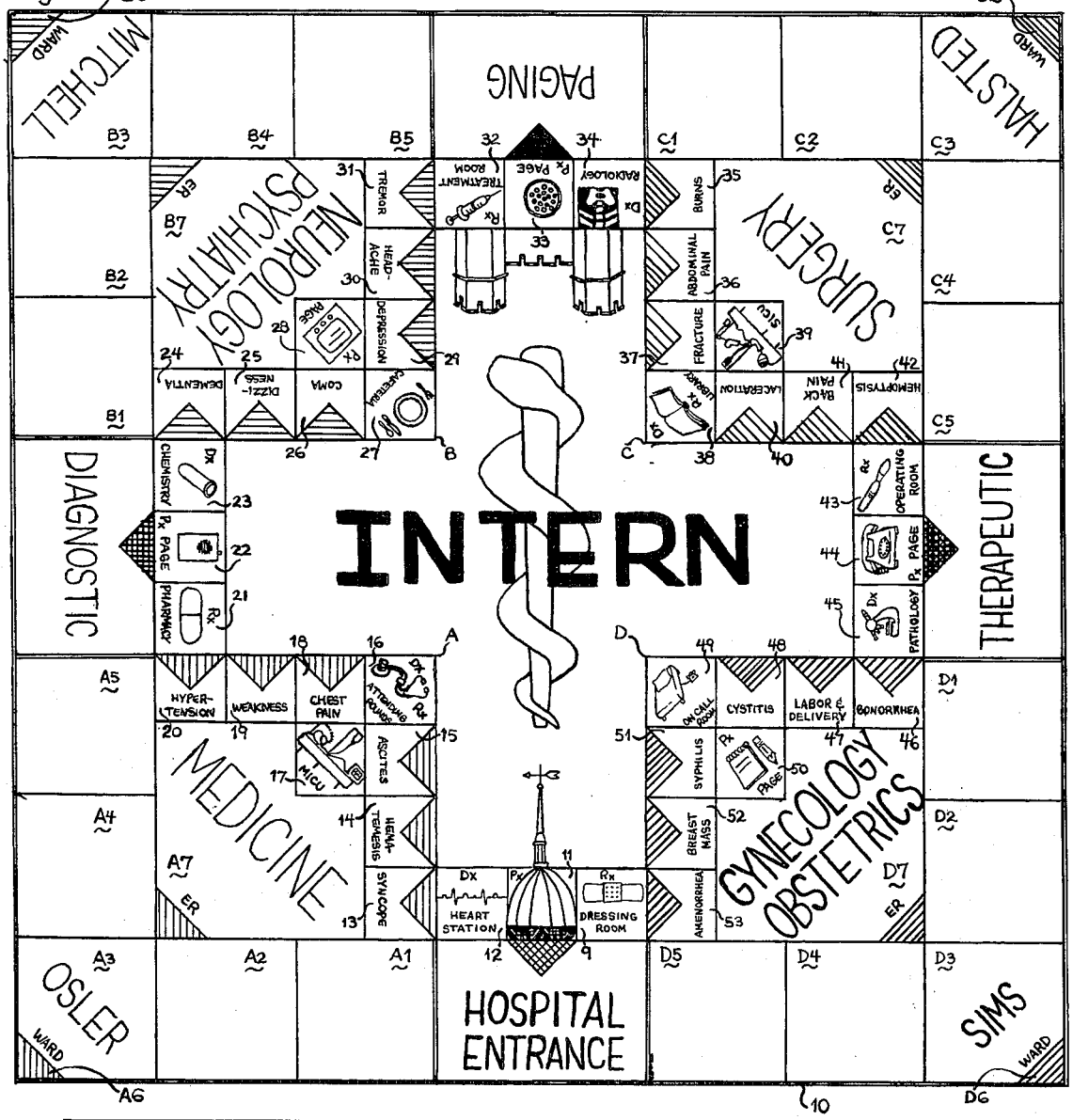
FIG. 1 is a plan view of one form of playing board used in the game of the present invention.

Referring specifically to FIG. 1, a game board 10 is divided into four guadrants, namely; A (Medicine); B (Neurology-Psychiatry); C (Surgery); and D (Gynecology-Obstetrics). Each quadrant includes a ward represented by five generally square spaces A1–A5, B1–B5, C1–C5 and D1–D5, each space representing one of five beds in the ward. The bed spaces are positioned to form an L-configuration at the periphery of the board 10 such that each ward is located at a respective board corner. In addition, each ward bears the name, appearing in one of the ward's bed spaces, of a famous American physician whose work relates to the specialty of that ward. In addition, at least one of the bed spaces in each ward is color-coded by means of a small triangle (A6, B6, C6, D6), the color representing the particular specialty. In the particular embodiment illustrated, medicine is represented by yellow, neurology-psychiatry by blue, surgery by red, and obstetrics-gynecology by green.

Positioned interiorly of the bed spaces making up each ward is the emergency room for each specialty, represented by large spaces A7, B7, C7 and D7, respectively. The emergency spaces may likewise contain the specialty-indicating color-coded triangles. A series of six patient spaces, appropriately color-coded, and two miscellaneous spaces are disposed adjacent the emergency room space around the inward sides thereof. These latter spaces are described in greater detail subsequently.

Figure 6:
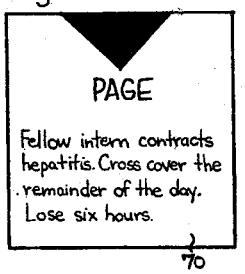
FIG. 6 is a view in elevation of the front side of a page card employed in said game.
Figure 7:
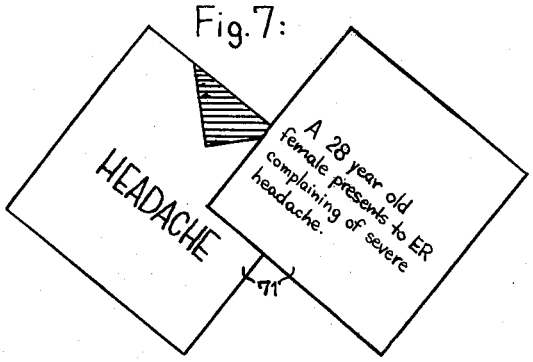
FIG. 7 represents the front and back sides of a typical patient card employed in said game.
Figure 8:
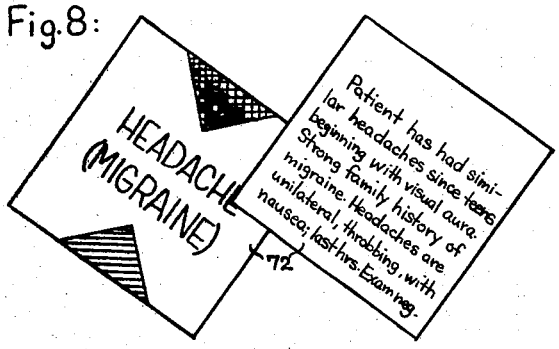
FIG. 8 represents the front and back sides of a typical diagnostic card employed in card games and suitable for diagnosing the aliment of the patient represented by the card of FIG. 7.
Figure 11:
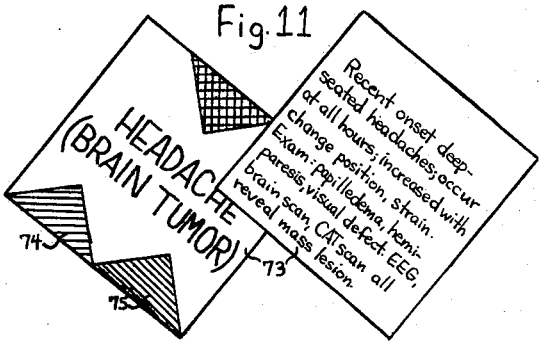
FIG. 11 represents a front and back sides of a typical diagnosis card of the type wherein the patient represented by the card of FIG. 7 is transferred to a specialty ward other than the ward to which that patient was admitted.
Figure 9:
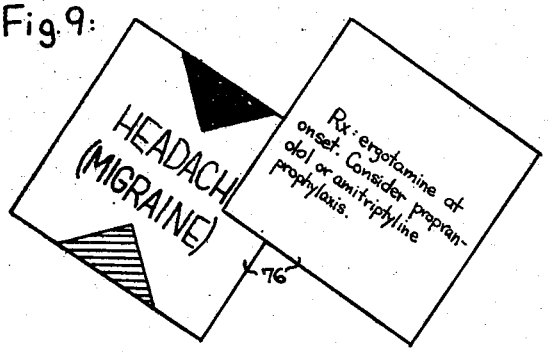
FIG. 9 represents the front and back sides of a typical therapeutic card employed in said game and suitable for treating the patient diagnosed according to the card of FIG. 8.
Figure 12:
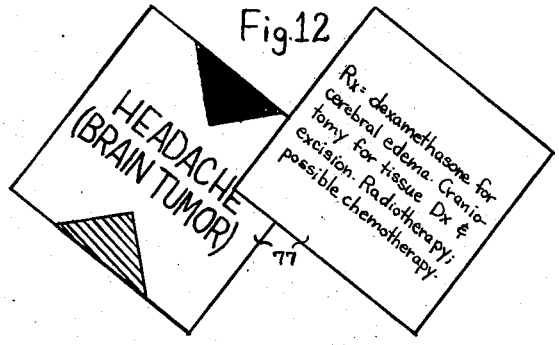
FIG. 12 represents the front and back sides of a therapeutic card employed to treat the patient diagnosed according to the card of FIG. 11.

A hospital entrance space, color-coded brown, is disposed at the periphery of board 10 between bed space D5 of ward D and bed space A1 of ward A. A diagnostic space, color-coded orange, is disposed at the board periphery between bed spaces A5 and B1. A paging space, color-coded black, is disposed at the board periphery between bed spaced B5 and C1. A therapeutic space, color-coded purple, is disposed at the board periphery between bed spaces C5 and D1. The hospital entrance space may serve as a repository for personnel cards which are described subsequently in relation to FIG. 5. The diagnostic cards, described in relation to FIGS. 8 and 11 are placed at the diagnostic space; the paging cards, described in relation to FIG. 6, are placed at the paging space; and the therapeutic cards, described in relation to FIGS. 9 and 12, are disposed at the therapeutic space. Patient cards, described in relation to FIG. 7, are placed in the emergency rooms according to their color codes or specialties.

A continuous playing path of spaces to be transversed by playing pieces is disposed inwardly of the bed and card spaces and the emergency room spaces. Starting at the hospital entrance there is a start space 11. Proceeding clockwise in sequence, the next space is a heart station 12 which is one of four diagnostic stations positioned along the playing path. This is followed by syncope 13, hematemesis 14, and ascites 15 spaces which are yellow-coded represent three of six patient spaces in medicine section A. The next space is the attending rounds space 16, one of two diagnostic and therapeutic spaces on the board. This is followed by three more yellow-coded medicine patient spaces, namely the chest pain 18, weakness 19 and hypertension 20 spaces. Disposed corner-to-corner with space 16 and adjacent each of spaces 15 and 18 is an MICU (medicine intensive care unit) space 17 which, as described subsequently, serves a functon analogous to the jail space in the game of Monopoly (U. S. Pat. No. 2,026,082).

Next in the playing path is pharmacy space 21, one of four therapeutic spaces along the playing path. This is followed by paging space 22, one of four such spaces along the path, and chemistry space 23 which is one of the four diagnostic spaces along the path. These are followed by blue-coded neurology-psychiatry patient spaces, namely: the dementia space 24, dizziness space 25 and coma 26. Cafeteria space 27 is one of two time penalty spaces in the path and is corner-to-corner with page space 28 which is one of two elective page spaces in the path. These are followed by three more blue-coded neurology-psychiatry patient spaces: depression 29, headache 30 and tremor 31. These are followed in turn by the treatment room 32 (a therapeutic space) page 33 and radiology 34 (a diagnostic space).

Continuing along the path into the surgery quadrant C, the next spaces are red-coded surgery patient spaces, namely: burns 35, abdominal pain 36 and fracture 37 spaces, followed by the library space 38 which is the second diagnostic and therapeutic space. Corner-to-corner with the library space is the SICU (surgery intensive care unit) space 39. Following the library space 38 are three more red-coded patient spaces, namely: laceration 40, back pain 41 and hemoptysis 42. The operating room 43 (another therapeutic space), paging space 44 and pathology (diagnostic) space 45 extend between surgery quadrant C and the gynecology-obstetrics quadrant D. In quadrant D the path continues with green-coded patient spaces for gonorrhea 46, labor and delivery 47 and cystitis 48. An on-call room space 49 is the second time penalty space in the path and is corner-to-corner with elective page space 50. Three more green-coded patient spaces follow, namely; syphilis 51, breast mass 52, and amenorrhea 53. The final therapeutic space, namely dressing room space 9, is positioned between space 53 and starting space 11 to complete the continuous playing path.

Figure 2:
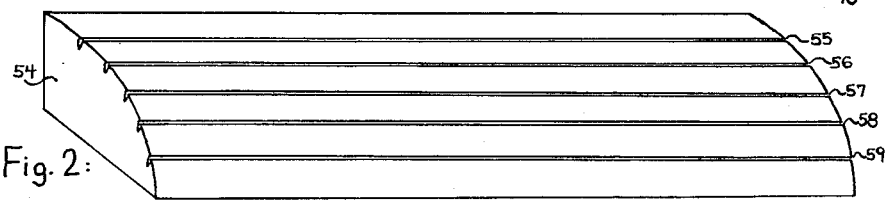
FIG. 2 is a view in perspective of a typical card rack employed in the game of the present invention.

Referring to FIG. 2, a card rack 54 is in the form of an elongated member having a flat bottom surface which meets a rear surface at right angles. An arcuate front surface extends between the bottom and rear surfaces and includes five channels 55, 56, 57, 58 and 59 which extend along the entire length of rack 54 at different levels. The channels are arranged to receive the bottom edge of various cards used in the game and support the cards so as to be visible by a player. One rack 54 is provided for each player.

Figure 3:
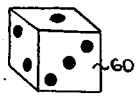
FIG. 3 is a view in perspective of one of two identical dice employed with the game of the present invention.

In FIG. 3 there is illustrated a conventional die 60 in the form of a cube. Two such dice are employed in the game.

Figure 4:
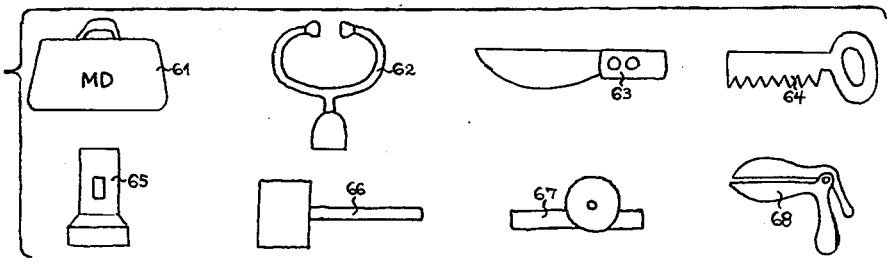
FIG. 4 is a view in elevation of certain tokens that may be used by different players in playing said game.

FIG. 4 illustrates eight player pieces which are used in the game. These player pieces are assigned one to a player and are moved about the playing path on board 10 in accordance with rolls of the dice. The player pieces are preferably symbols which have meaning in the field of medicine. The particular pieces illustrated include: physician's bag 61, stethoscope 62 (Medicine pieces), knife 63, saw 64 (Surgery pieces), flashlight 65, mallet 66 (Neurology Psychiatry pieces), reflector headpiece 67, and speculum 68 Gyn-Obstetrics pieces).

Figure 5:
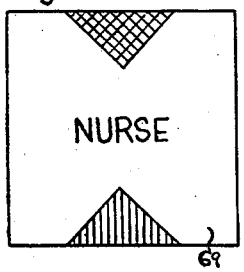
FIG. 5 is a view in elevation of the front side of a personnel card employed in said game.

Referring to FIG. 5, a typical personnel card 69 is shown and bears a brown triangle code on top and a yellow color code on bottom. Illustrated personnel card 69 bears the legend "Nurse". Twenty-eight such cards are provided with the game, there being seven for each of the four specialties. Thus, all 28 personnel cards are color-coded brown on top, but bear a color code corresponding to the four different specialties on the bottom. There is no printing on the reverse side of the personnel cards.

A typcial page card 70 is illustrated in FIG. 6. There are 56 page cards in the game, all of which are color-coded black at top. Each page card specifies a gain or loss of time, a particular placement of the playing piece, exchange of diagnosis or treatment cards between players, or various patient complications.

FIG. 7 illustrates a typical patient card 71. The front side of each patient card has the name of the patient's symptom (e.g. "Headache") thereon and is color-coded at the top for the specialty which handles that symptom. Thus the HEADACHE card 71 is color coded with a blue triangle at its top to signify neurology-psychiatry. The reverse side of card 71 describes the patient and the nature of the complaint. There are 24 patient cards in the game, one for each patient space along the playing path. Thus, the particular headache card 71 illustrated in FIG. 7 corresponds to the headache space 30 in FIG. 1.

FIG. 8 illustrates a typical diagnostic card 72. All diagnostic cards are color coded on their front side with an orange triangle at the top. In addition, each diagnostic card has a brief diagnosis appearing on the front side; e.g. "HEADACHE (Migraine)". Further, the diagnostic cards are color-coded with either one or two triangles on the bottom. A diagnostic card having one bottom color code triangle represents a diagnosis which requires treatment by the specialty department in which patient was admitted. In such circumstances the one bottom color code triangle is the same as the specialty code. Therefore, since the HEADACHE (Migraine) card 72 is properly treated in the neurology-psychiatry department, the bottom triangle is blue. In FIG. 11 there is illustrated a HEADACHE (Brain Tumor) card 73 which is the alternative headache diagnosis card. This card bears the same orange triangle at the top but includes both a blue triangle 74 and a red triangle 75 at the bottom to signify that treatment is proper in surgery rather than in neurology-psychiatry. There are 48 diagnosis cards, 24 having one color code at the bottom, 24 having two color codes at the bottom. There is a one-code and a two-code diagnosis card corresponding to each patient card so that it is possible for each patient to be treated in two specialty departments, even though that patient can only be initially admitted to the ward of one specialty. The manner in which a patient is transferred from one ward to another is described subsequently. For present purposes, however, it should be noted that each of the six patients capable of being admitted into any specialty can be transferred to another specialty, two per each specialty. A description of the diagnosis appears on the reverse side of each diagnosis card.

Referring to FIG. 9, the therapy or treatment card 76, corresponding to the treatment required for diagnosis card 72, is illustrated. All therapy cards are coded with a purple triangle at the top of its front side and a specialty color triangle at the bottom. In the case of the HEADACHE (Migraine) treatment card 76, the bottom triangle is blue (neurology-psychiatry). In FIG. 12 there is illustrated a HEADACHE (Brain Tumor) treatment card which has a purple top triangle and red (surgery) bottom triangle. There are fifty-two therapy cards, one for each diagnosis card plus four complication treatment cards. Complication treatments are required during the course of the game if particular paging cards are drawn. There is one complication treatment card for each specialty.

Figure 10:
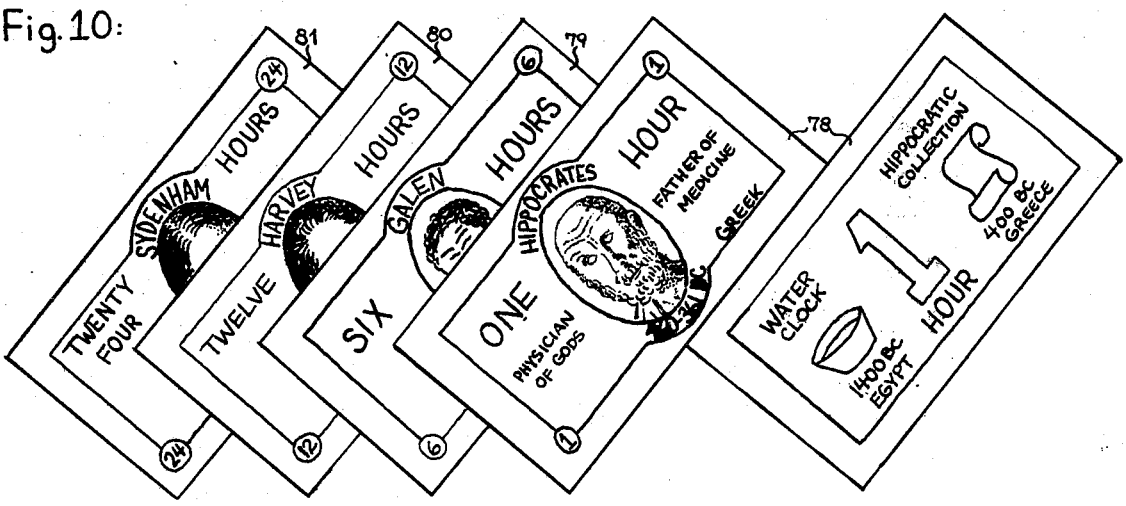
FIG. 10 represents typical time scrip employed in said game.

In FIG. 10 there are illustrated four different units of scrip 78, 79, 80 and 81. The front side of each unit denotes the number of hours it is worth and bears a picture and name of a person having historical significance in medicine. The reverse side (only unit 78 being shown) also shows its unit value plus significant implements and documents in the history of medicine.

In preparing to play the game, and assuming four players, the six patient cards 71 for each specialty are placed in the corresponding emergency room spaces A7, B7, C7 and D7. The 48 diagnosis cards 72, 73, the 52 treatment cards 76, 77 and the 56 paging cards 78 are shuffled and placed in respective stacks at the DIAGNOSTIC, THERAPEUTIC and PAGING spaces on the board 10. Each player chooses a specialty and is given a token 61 – 68 to traverse the playing path. The personnel cards 69 may be distributed to the players according to specialty as needed. Each player begins the game with 6 hours of time (scrip, FIG. 10), two diagnosis cards 72, 73 and two treatment cards 76, 77, the cards being dealt randomly from the respective decks. Each player then rolls the dice and the highest roll takes the first turn, after which turns proceed clockwise.

The first player rolls the dice and moves the number of spaces shown, beginning at the hospital entrance 11 which counts as one space. The space on which the token lands may entitle the intern to admit a patient, obtain diagnostic or therapeutic information, oblige him to answer a page, etc. To admit a patient from the emergency room (ER) to his ward, the player-intern must land on one of the six patient spaces on the board corresponding to a patient with complaints related to his department and correspondingly color coded. He may then spend two hours of his time, by returning scrip to Time Bank, to move that patient's card from the Emergency Room to one of five bed spaces 1–5 on his department's ward. If the intern's token lands on one of four spaces designated Dx or Diagnostic (e.g. Heart Station 12, Chemistry Lab 23, Radiology 34, or Pathology 45, and color coded orange, he is entitled to obtain one diagnostic card 72, 73 and return one hour of his time to the time bank. If the intern lands on one of four spaces marked Therapeutic (Rx) (e.g. Pharmacy 21, Treatment Room 32, Operating Room 43, or Dressing Room 9), and color coded purple, he is entitled to obtain one treatment (Rx) card in exchange for one hour of his time. If the intern's token lands on one of two spaces designated both Diagnostic and Therapeutic (e.g. Attending Rounds 16, or Library 38), he is entitled to obtain one diagnostic and/or one treatment card in exchange for two/one hour(s) of time. If the intern lands on one of four spaces specifically designated as *Page* (e.g. entrance 11, beeper 22, intercom 33, or telephone 44), he is obliged to pick up a Paging Card 70 from the stack and respond to its instructions without delay. If the intern lands on the spaces marked Cafeteria 27 or On Call Room 49, he is obliged to spend either 1 hour (for dinner), or 3 hours (sleeping) by paying the appropriate amount of scrip to the Time Bank. Alternatively, he may elect to answer one page (TV monitor 28) in the cafeteria or two pages (note pad 50) from the on call room, and respond without delay or penalty.

The space designated as Entrance serves as starting point for the game. Whenever passing the hospital entrance during the course of the game the intern receives six additional hours from the Time Bank. If the token lands directly on the entrance, he must also pick a paging card and respond accordingly. If a player rolls doubles on the dice he is entitled to an additional roll of the dice. Landing on any of the six spaces with his department's color entitles him to an additional roll. However, any intern who receives more than three consecutive rolls of the dice is obliged to go directly to the Intensive Care Unit (Medicine and Neurology-Psychiatry interns to the MICU 17; Surgery and Obstetrics-Gynecology interns to the SICU 39). A player's turn ends on being sent to either ICU and he may not pass the entrance or collect 6 hours scrip en route. The intern must remain in the ICU for three turns unless he remits 6 hours, or is relieved of his duty by a paging card, or obtains doubles on a subsequent roll.

After a patient has been admitted to a ward by an intern, the patient card remains in the ward until a diagnosis card is drawn which pertains to his symptom. For each patient there are two relevant diagnosis cards, one of which 72 contains additional data leading to a diagnosis appropriate to that department, and obliging the intern to seek the corresponding Treatment card. Another card 73 contains information leading to a diagnosis of a problem more appropriately managed by another department, and entitling the intern to transfer that patient to one of the other three departments. If an intern has both cards, he may choose to use either. To establish a diagnosis, the intern must obtain and place an appropriate diagnosis card 72 on the corresponding patient card in his ward. To transfer a patient, the intern must obtain and place the appropriate (bicolored) diagnosis card 73 on the corresponding patient card in his ward, and then transfer both to the receiving department's ward.

After the patient has been admitted and diagnosed and/or transferred, he must be correctly treated. To treat and discharge a patient from the hospital the intern must obtain the treatment card corresponding to the diagnosis card already applied to the patient on his ward; all are the removed from the ward and retained by the intern for later scoring. Extraneous diagnsosis and treatment cards corresponding to that patient are simultaneously removed from play.

All diagnosis and treatment cards are read aloud as they are obtained. They are then divided into two groups. Those of relevance only to other interns are identified with and concealed behind one of seven personnel cards in the top row of the card rack 54. Those of immediate or potential use to the intern who receives them are placed in the card rack in the following order: second row intradepartmental diagnosis cards; third row intradepartmental treatment cards; fourth row diagnosis cards for patients for transfer to other departments; fifth row treatment cards for patients transferred from other departments. If an intern's token lands on any of the eighteen color coded Sx (patient symptom) spaces within another department, he is obliged to surrender any diagnostic or therapeutic card behind any personnel card specifically requested by that department's intern in exchange for one hour of time (rendered to the time bank).

When all five beds on an intern's ward are filled with patients his service is locked and he may not accept any transfer from another service. However, he may not artificially keep in his ward more than two patients who are ready for discharge from the hospital or transfer to another department. If an intern's service is locked and he wishes to admit an additional patient from the Emergency Room, he may do so by boarding that patient on another department's ward at a cost of 4 hours to the receiving intern intially and an additional 2 hours for each trip around the board while that patient is boarded (payable at the hospital entrance). That patient may be transferred back to the admitting intern's own ward when a bed becomes available; if this requires discharge or transfer of a patient, it must wait until the intern's next turn. The patient must be transported to his correct ward (if a bed can be emptied) immediately if the boarding service has a potential admission which cannot otherwise be accommodated. The intern may at any time and only during his turn admit, diagnose, transfer, treat or discharge any patient. However, he is not obliged to do so except as stated in this paragraph. An intern may discharge a maximum of three patients per turn.

Play is ended when one intern has discharged or transferred all his patients.

| Scoring is calculated as follows for each player: | |
|---|---|
| Total No. hours collected | +No. |
| Each patient discharged | +6 |
| Each patient transferred | +4 |
| Each transfer patient discharged | +2 |
| Each complication discharged | +4 |
| Total No. of extraneous relevant cards | +No. |
| Patient remaining off service | −6 |
| Patient remaining in Emergency Room | −6 |
| Undiagnosed patient on ward | −4 |
| Untreated patient on ward | −2 |
| Complication untreated | −4 |
| Transfer patient untreated | −4 |

The game as described is intended for four players, with six patients a-piece. However, it may also be played well by 2, 3, 6, or 8 players (with 12, 8, 4, or 3 patients who should be designated at the start of the game). Additional tokens are included for this purpose.

The game may be played on two levels, depending on the clinical expertise of the players. The novice form of the game requires no actual medical knowledge. Clinical decisions concerning diagnosis, transfer and therapy have been predetermined and color coded on the front of each card. Medical novices may turn the cards over to learn the specifics of these clinical decisions, but the entire game may be played using only the front of the cards. Alternatively, INTERN may be played using only the back (uncoded) side of each card, forcing each player to make his own decisions concerning appropriate diagnosis and management of patients based upon the presenting signs, symptoms, and subsequent hospital studies as presented on rear of the cards. Cards are turned over at the time of transfer or discharge; and inappropriate decisions are penalized at 2 hours per error. It is suggested that this form of the game be attempted only after a trial at the regular form in order to avoid any confusion.

It should be noted that the game may be played without time scrip, whereby the first intern to discharge or transfer all of his or her patients is declared the winner.

Many physical features of the game as described can be changed without departing from the scope of this invention. For example, any chance-determining apparatus, such as a spinner, etc. may be used instead of dice. The particular layout of spaces on board 10 can be varied in many ways. For example, not all of the patient spaces for a given specialty need be located in a cluster; rather they can be intermingled about the board. Likewise, the path of playing spaces may be disposed about the periphery of board 10 with the bed spaces and card repository spaces moved to the interior or off the board entirely. Moreover, while color coding is preferred, numeric, alphanumeric, symbolic or other coding may be employed.

For a fuller understanding of the subtleties of the game, as played according to the guidelines set forth above, the following list is provided in which all of the various cards are described:

I. Personnel Cards (28)

Six for all departments: Attending Physician, Resident, Head Nurse, Nurse, Secretary, Orderly Medicine — Social Worker Neurology Psychiatry — Physical Therapist Surgery — Physician's Associate Gynecology Obstetrics — Dietitian II. Patient Cards (24)

Medicine — Syncope, Weakness, Hematemesis, Chest Pain, Hypertension, Ascites

Neurology Psychiatry — Tremor, Coma, Headache, Dementia, Dizziness, Depression

Surgery — Fracture, Hemoptysis, Laceration, Burns, Abdominal Pain, Back Pain

Gynecology Obstetrics — Cystitis, Gonorrhea, Syphilis, Labor and Delivery, Breast Mass, Amenorrhea III. Diagnostic Cards (49)

(All correspond respectively (in order) to previously mentioned patient symptoms). In addition, the following transfer diagnostic cards are provided:

Medicine (Intradepartmental) — Stokes-Adams Attacks, Diabetes Mellitus, Peptic Ulcer Disease, Angina Pectoris, Essential Hypertension, Laennec's Cirrhosis Medicine (Transfer) —

To Neurology — Transient Ischemic Attacks, Myasthenia Gravis

To Surgery — Gastric Carcinoma, Dissecting Aortic Aneurysm

To Gynecology — Preeclampsia, Meig's Syndrome

Neurology Psychiatry (Intradepartmental) — Parkinson's Disease, Putamenal Hemorrhage, Migraine, Alzheimer's Disease, Multiple Sclerosis, Manic-Depressive Psychosis Neurology Psychiatry (Transfer) —

To Medicine — Hyperthyroidism, Drug Overdose

To Surgery — Brain Tumor, Parathyroid Adenoma

To Gynecology — Hydatidiform Mole, Reactive Depression

Surgery (Intradepartmental) — Fracture, Lung Carcinoma, Laceration, Burn, Acute Appendicitis, Ruptured Intervertebral Disc Surgery (Transfer) —

To Medicine — Multiple Myeloma, Pulmonary Embolus

To Neurology — Seizure Disorder, Syringomyelia

To Gynecology — Ectopic Tubal Pregnancy, Carcinoma of the Cervix

Gynecology Obstetrics (Intradepartmental) — Cystitis Gonorrhea, Syphilis, Labor and Delivery, Chronic Cystic Mastitis, Polycystic Disease of the Ovary Gynecology Obstetrics (Transfer) —

To Medicine — Chronic Pyelonephritis, Disseminated Gonorrhea,

To Neurology — Tabes Dorsalis, Cerebral Vein Thrombosis

To Surgery — Carcinoma of the Breast, Pituitary Adenoma

IV. Treatment Cards (52)

One for each of the previously mentioned 48 diagnoses

In addition treatments for four complications (Page Cards) —

Medicine — Myocardial Infarction

Neurology Psychiatry — Cerebrovascular Accident

Surgery — Incarcerated Femoral Hernia

Gynecology Obstetrics — Carcinoma of the Endometrium

V. Time Scrip (Historical Medical figure, advancement, time piece)

One Hour — Hippocrates, Hippocratic Collection, Water Clock

Six Hours — Galen, Mortar and Pestle, Sundial

Twelve Hours — Harvey, Compound Microscope, Spring Watch

Twenty-Four Hours — Sydenham, Liquid Thermometer, Pendulum Clock

VI. Paging Cards (56)

Detrimental — intravenous line infiltrates, urinalysis not done, nursing rounds, called to sedate, patient in X-Ray, do clotting time, patient develops fecal impaction, clinic patient needs prescription filled, Blood bank discards specimen, write off-service notes, technician could not draw blood specimen, patient develops fever, patient has allergeic reaction to dye in X-Ray.

Utilization Review — discharge all possible patients, medical student conference, patient has cardiac arrest, mispaged, pharmacy out of stock, lab error, give consultation to medicine, Neurology, Surgery, Gynecology, replace intern on Intensive Care Unit, transfer of chronically ill patient from local physician, complication — myocardial infarction, cerebrovascular accident, incarcerated femoral hernia, endometrial carcinoma, late for clinic, court appearance for malpractice suit, fellow intern contracts heptatis, undictated discharge summaries discovered.

Advantageous

Secretary fills out lab requisitions, nurse restarts IV, patient's psychosomatic complaints disappear, medical records finds old chart, patient leaves hospital against advice, house staff picnic, patient requests transfer to VA hospital, Student faculty show, Grand Rounds, Nursing Home bed becomes available, professor arrives for attending rounds, Receive Consult from — Medicine, Neurology, Surgery, Gynecology, out of ICU free, chief resident gives consult, Christmas party, free drug sample, Fourth year student/cross covering intern admit a patient for you.

While I have described and illustrated one specific embodiment of my invention, it will be clear that variations of the details of construction which are specifically illustrated and described may be resorted to without departing from the true spirit and scope of the invention as defined in the appended claims.

We claim:

1. A board game apparatus for a game to be played by a plurality of players, said apparatus comprising:

a plurality of playing pieces, one for each player;

a playing board having a plurality of marked sequential spaces constituting a playing path to be traversed by said playing pieces;

means associated with the majority of said sequential spaces for identifying them as different patient symptom spaces, said patient symptom spaces including: a first plurality of spaces marked to additionally identify them with a first medical speciality; and a second plurality of spaces marked to additionally identify them with a second medical speciality;

means associated with a first majority of said sequential spaces for identifying them as diagnosis spaces;

means associated with a second minority of said sequential spaces for identifying them as treatment spaces;

change-determining means responsive to actuation by each player for indicating a number of said sequential spaces to be traversed by that player's piece in one turn;

a plurality of diagnostic cards, at least one for each of said patient symptom spaces, each identifying the patient symptom corresponding to a patient symptom space and a diagnosis for that patient symptom;

a plurality of treatment cards, at least one for each of said diagnosis cards, each identifying a patient diagnosis and symptom corresponding to a patient symptom space and a treatment for that patient diagnosis;

whereby each player is assigned a medical specialty and is entitled to admit a patient for diagnosis when the player's piece lands on a patient symptom space marked with that player's medical specialty, is entitled to collect diagnostic cards when said playing piece lands on a diagnosis spaces, is entitled to diagnose a patient when a collected diagnosis card corresponds to the symptom of an admitted patient, is entitled to collect treatment cards when said playing piece lands on treatment spaces, and is entitled to treat and discharge a patient when a collected treatment card corresponds to the symptom and diagnosis of an admitted patient.

2. The apparatus according to claim 1 further comprising:

means associated with a third minority of said sequential spaces for identifying them as paging spaces;

a plurality of paging cards, each identifying a certain task to be performed by a player picking that card and designating the amount of time required to perform that task, whereby a player is required to pick paging cards whenever that player's playing piece lands on paging spaces; and scrip means in units of time.

3. The apparatus according to claim 1 wherein said diagnostic cards include at least two for each of said patient symptom spaces, one of the two being identified for diagnosis for which treatment is properly performed in the medical specialty marked on the corresponding patient symptom space, the other of the two being identified for diagnosis whose treatment is properly performed in a medical specialty other than that marked on the corresponding patient symptom card.

4. The apparatus according to claim 1 further comprising a plurality of areas on said playing board designated as ward, one area for each assigned medical specialty, each area being subdivided into a plurality of segments, and each area including means for identifying that area with a particular assigned medical specialty.

5. The apparatus according to claim 1 further comprising a plurality of patient cards, at least one for each of said patient symptom spaces, each identifying a corresponding patient symptom and including means for identifying the medical specialty with which the corresponding patient symptom space is marked.

6. The apparatus according to claim 1 further comprising a plurality of racks, one for each player, each rack being arranged to support said diagnostic cards and said treatment cards at different levels.

7. The apparatus according to claim 6 further comprising a plurality of personnel cards, an equal number for each player, and wherein said rack includes means for supporting said personnel cards at a higher level than all other cards.

8. The apparatus according to claim 1 further comprising:

scrip means marked in units of time.

9. The apparatus according to claim 1 wherein said playing pieces are in the form of miniature medical instruments which may correspond to specialties.

* * * * *

UNITED STATES PATENT AND TRADEMARK OFFICE

CERTIFICATE OF CORRECTION

PATENT NO. : 4,136,879

DATED : January 30, 1979

INVENTOR(S) : CLIFFORD G. ANDREW; LOUISE B. ANDREW

It is certified that error appears in the above-identified patent and that said Letters Patent are hereby corrected as shown below:

Column 1, line 42, change "teching" to ---teaching---.

Column 5, line 15, change "typcial" to ---typical---.

Column 7, line 53, change "diagnsosis" to ---diagnosis---.

Column 10, line 4, after "Cystitis" add a comma ---,---.

Column 10, line 34, after "sedate" delete the comma ",".

Column 10, line 39, change "allergeic" to ---allergic---.

Column 11, line 21, change "change" to ---chance---.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,136,879

DATED : January 30, 1979

INVENTOR(S) : CLIFFORD G. ANDREW and LOUISE B. ANDREW

It is certified that error appears in the above-identified patent and that said Letters Patent are hereby corrected as shown below:

Column 11, claim 1, line 16, change "majority" to ---minority---.

Signed and Sealed this

*Twenty-sixth* Day of *February 1980*

[SEAL]

*Attest:*

SIDNEY A. DIAMOND

*Attesting Officer*

*Commissioner of Patents and Trademarks*